US006260909B1

(12) United States Patent
Crean et al.

(10) Patent No.: US 6,260,909 B1
(45) Date of Patent: Jul. 17, 2001

(54) AWNING AND RUG ASSEMBLY FOR A TRAILER

(75) Inventors: Johnnie Robert Crean, Chino; Stephen B. Wishek, West Corona, both of CA (US)

(73) Assignee: Alfa Leisure, Inc., Chino, CA (US)

( * ) Notice: Subject to any disclaimer, the term of this patent is extended or adjusted under 35 U.S.C. 154(b) by 0 days.

(21) Appl. No.: 09/605,203

(22) Filed: Jun. 27, 2000

Related U.S. Application Data

(63) Continuation-in-part of application No. 09/045,777, filed on Mar. 19, 1998, now Pat. No. 6,131,990.

(51) Int. Cl.[7] ..... B60R 15/00

(52) U.S. Cl. ..... 296/163; 160/60; 160/66; 135/88.01; 135/88.11

(58) Field of Search ..... 296/163; 160/22, 160/23.1, 25, 45, 55, 60, 26; 135/88.1, 88.11, 88.12, 88.01, 88.07

(56) References Cited

U.S. PATENT DOCUMENTS

| | | |
|---|---|---|
| 2,788,791 | 4/1957 | Pospisil et al. . |
| 3,902,752 | 9/1975 | Pelletier . |
| 3,918,510 | 11/1975 | Hayward . |
| 4,109,954 | 8/1978 | Wall . |
| 4,175,576 | 11/1979 | Iby . |
| 4,468,823 | 9/1984 | Tounjian . |
| 4,719,954 | 1/1988 | Curtis et al. . |
| 4,729,594 | 3/1988 | Hoff . |
| 4,867,502 | 9/1989 | Sylvester et al. . |
| 5,100,716 | 3/1992 | Juneau . |
| 5,199,120 | 4/1993 | Holmes . |
| 5,358,298 | 10/1994 | Fate . |
| 5,419,607 | 5/1995 | Oliveira . |
| 5,529,825 | 6/1996 | Sutherland . |
| 5,566,918 | 10/1996 | Becker . |
| 5,718,253 | 2/1998 | McNamee . |

FOREIGN PATENT DOCUMENTS

| | | |
|---|---|---|
| 4204640 A1 | 8/1993 | (DE) . |

OTHER PUBLICATIONS

Carefree Today, Sidewinder II, vol. 8, Issue 1, p. 19, 1997.

*Primary Examiner*—Joseph D. Pape
(74) *Attorney, Agent, or Firm*—Knobbe, Martens, Olson & Bear, LLP

(57) ABSTRACT

Disclosed is an awning assembly for a recreational vehicle. The awning assembly includes an awning that is configured to be extended from a sidewall of the recreational vehicle to provide shade. A rug is removably mounted to one edge of the awning. In use, the rug is removed from the awning and positioned on the ground below the awning to serve as a ground covering. When not being used, the rug is attached to the awning and stored with the awning in an awning housing to save space. In another embodiment, the awning assembly comprises a rug housing that is configured to be moved between a storage configuration and an extended configuration.

19 Claims, 13 Drawing Sheets

AWNING AND RUG ASSEMBLY FOR A TRAILER

RELATED APPLICATIONS

This application is a Continuation-in-Part of U.S. patent application No. 09/045,777, filed Mar. 19, 1998, now U.S. Pat. No. 6,131,990, entitled "TRAILER AWNING ASSEMBLY WITH DETACHABLE RUG".

BACKGROUND OF THE INVENTION

1. Field of the Invention

The invention relates to recreational vehicles. More particularly, the invention relates to an awning assembly for a recreational vehicle wherein the awning assembly includes a detachable rug that is adapted to be stored within a housing of the awning assembly.

2. Description of the Related Art

Recreational vehicles ("RVs") are large vehicles that are equipped with many of the facilities of a home, such as a bedroom, a kitchen, and a family room. Travelers often take recreational vehicles on long trips and use the vehicles as lodging rather than staying in a hotel. Prior to leaving on a long trip, the traveler typically packs the vehicle to capacity with a sufficient amount of supplies, such as luggage and food, to last the entire trip. Consequently, the traveler must carefully plan which items will be taken on the trip, as storage space is limited.

During the trip, the recreational vehicle is typically parked in an RV park, where the recreational vehicle provides the traveler with a place to eat, sleep, and to generally relax. Travelers spend much of their time simply lounging and relaxing around the recreational vehicle and enjoying their vacation. While lounging as such, the traveler often extends an awning from the side of the vehicle to provide protection from the sun. During travel, the awning is adapted to be stored in a rollbar that is mounted to the side wall of the recreational vehicle. When the RV is parked, the traveler pulls the awning out of the rollbar so that the awning is stretched and suspended outward from the side of the vehicle. Typically, a pair of cantilevered arms extend outward from the side of the vehicle and are attached to the awning to keep the awning suspended. Oftentimes, the traveler will also attach a series of screens to the edges of the awnings. The screens hang downward toward the ground and thereby define a screened room beneath the awning that serves as a patio area which is more secure from dust and insects.

While the awning provides protection from the sun and the screens generally provide protection from wind and debris, the ground surface under the awning may be unpaved and dirty. Thus, it is often desirable to cover the ground beneath the awning with a rug or a carpet to cover any dust or debris and provide a generally clean and sanitary lounging area for the traveler. Without such a rug, dirt can be tracked into the RV which can be very difficult to clean up when on vacation. Unfortunately, there are a number of drawbacks associated with these rugs.

One such drawback relates to the large size of the rugs, which must be large enough to cover the area of the ground under the awning adjacent the door. Consequently, the rugs are bulky and cumbersome and thus use up a great deal of the limited storage space within the recreational vehicle when the rug is not being used. Hence, in order to bring along a rug on the trip, the traveler often has to leave behind other supplies that might otherwise be taken on the trip.

Moreover, these large rugs are also difficult to carry and maneuver, which makes it especially difficult to pack the rugs and to clean the rugs after use. Because the rugs are often laid over a dirty ground surface, the bottom surface of the rug tends to collect dirt and other debris during use which can be carried into the RV during storage of the rug. One way of cleaning the rugs after use is to hang the rug and strike the rug till the debris falls to the ground. However, after the rug is cleaned, the traveler often drags the rug to the storage area which dirties the rug again. Hence, the rug is often stored in a dirty state, which increases the work of the traveler in keeping the RV clean during the trip.

There is therefore a need for a recreational vehicle rug that may be used in combination with an awning to provide a clean ground surface for the traveler to lounge and relax. Preferably, the rug should not take up much storage space within the recreational vehicle and should also be stored in a location where it does not use up storage space in the recreational vehicle nor require the rug to be carried into the recreational vehicle along with dirt and debris adhering to the rug. Furthermore, the rug should be large enough to cover a sufficient amount of ground surface yet still be easy to clean after use.

SUMMARY OF THE INVENTION

The aforementioned needs are satisfied by the present invention which relates to an awning and rug assembly for a recreational vehicle. In particular, the awning and rug assembly is comprised of an awning assembly and a rug assembly. Furthermore, the awning assembly is comprised of an awning, wherein the awning has a storage configuration and a deployed configuration. Moreover, the awning, in the deployed configuration, extends into a planer shape that extends from a first wall of the recreational vehicle. Furthermore, the rug assembly is comprised of a rug and a roller assembly, wherein the rug is adapted to be stored within the roller assembly when the rug is placed in a non-extended configuration. In addition, the rug can also be positioned outside of the roller assembly when the rug is placed in an extended configuration. Furthermore, the roller assembly is mounted to the first wall of the recreational vehicle so as to be positionable in a storage configuration and a deployed configuration, wherein the roller assembly, in the deployed configuration, is positioned adjacent the ground so as to allow the rug to be conveniently positioned on the ground when the rug is placed in the extended configuration.

In one embodiment, the awning and rug assembly is adapted to mount to a first surface. In particular, the awning and rug assembly contains an awning assembly having a storage configuration and a deployed configuration, wherein the awning, in the deployed configuration, extends into a planer shape that extends from the first surface. Furthermore, the awning and rug assembly contains a rug assembly mounted on the first surface, wherein the rug assembly is comprised of a housing, a rug, a spool, and a plurality of support members. Moreover, a first end of each of the plurality of support members of the rug housing is mounted to the housing and a second end of each of the plurality of support members of the rug housing is pivotally mounted to the first surface so that the housing of the rug assembly can be placed in a storage configuration and a deployed configuration. Furthermore, the rug is adapted to wind around the spool, which is rotatably mounted inside the housing, and be confined within the housing when the rug is placed in a non-extended configuration. Moreover, the rug is also adapted to unwind from the spool and extend outside of the housing when the rug is placed in an extended configuration. In addition, the housing, when placed in the deployed configuration, is located adjacent a second surface so as to allow the rug to cover a portion of the second surface that lies underneath the awning when the awning is placed in the deployed configuration.

One aspect of the invention involves a rug assembly for a recreational vehicle, the rug assembly comprising a plurality of support members pivotally mounted to a first wall of the recreational vehicle at a first end of the each support members. The rug assembly of this embodiment further comprises a housing mounted to a second end of each support member so as to allow the housing to be moved between a storage configuration and a deployed configuration. In addition, the housing, in the deployed configuration, is positioned adjacent the ground. The rug assembly of this embodiment further comprises a spool which is rotatably mounted within the housing. The rug assembly of this embodiment further comprises a rug having a non-extended configuration and an extended configuration, wherein the rug, in the non-extended configuration, is adapted to wind around the spool and be confined within the housing. Furthermore, the rug, in the extended configuration, is adapted to unwind from the spool and extend from the housing so as to cover a portion of the ground adjacent the recreational vehicle when the housing is placed in the deployed configuration.

The awning and rug assembly of the present invention provides a number of advantages. For example, because the awning and rug are stored in different locations, the rug can be operated independently of the awning. Additionally, the rug does not have to be stored within the recreational vehicle so that the rug does not bring debris into the recreational vehicle after use. The rug is also easily cleaned after use by shaking the rug while the housing of the rug assembly is placed in the storage configuration and the rug is placed in the extended configuration so as to remove dirt from the rug. These and other objects and advantages of the present invention will become more apparent from the following description taken in conjunction with the accompanying drawings.

BRIEF DESCRIPTION OF THE DRAWINGS

These and other features of the invention will now be described with reference to the drawings of a preferred embodiment, which are intended to illustrate and not to limit the invention and in which.

DETAILED DESCRIPTION OF THE PREFERRED EMBODIMENT

Figure 1:
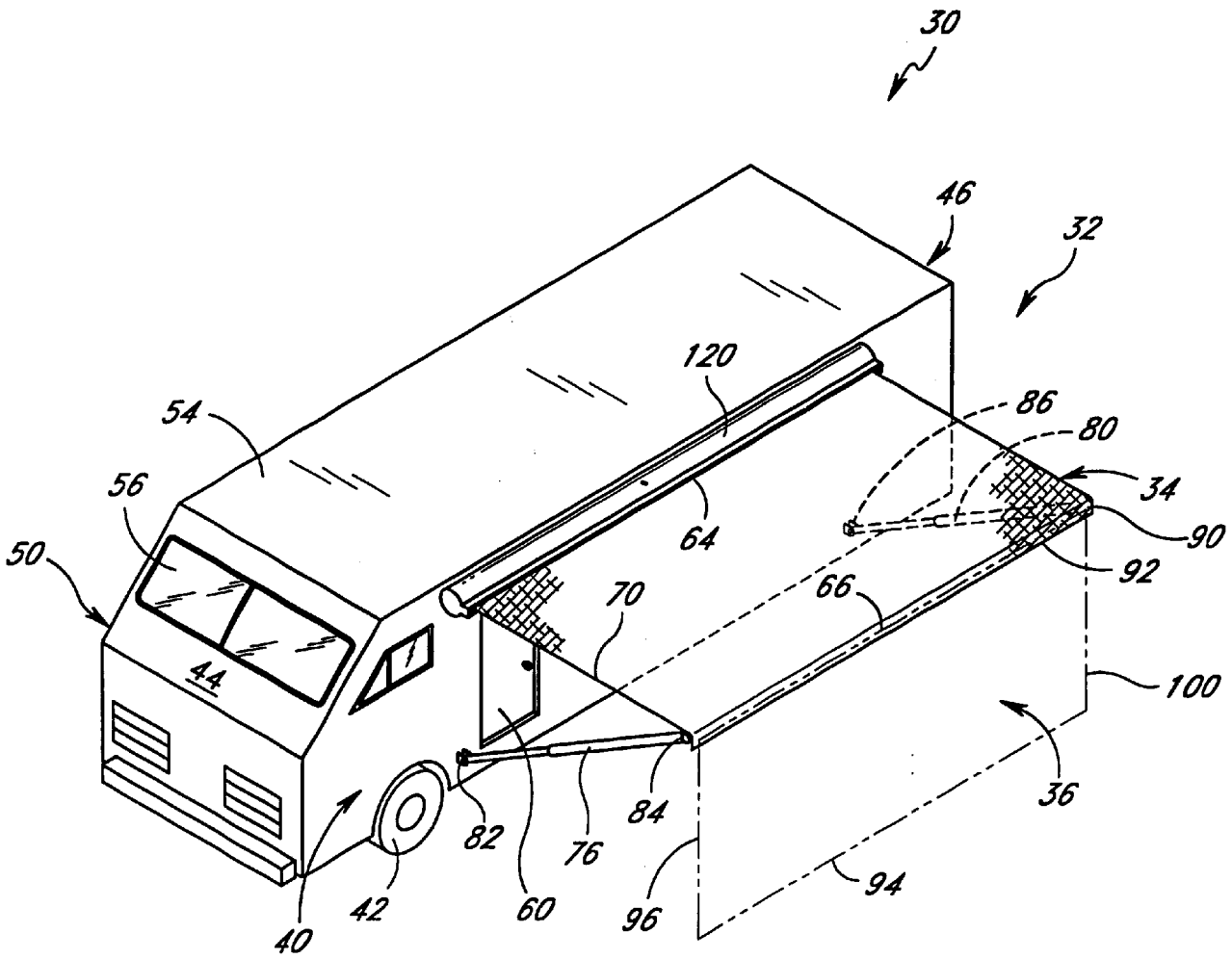
FIG. 1 is a perspective view of the awning assembly of a first embodiment of the present invention mounted to a recreational vehicle.

FIG. 1 is a perspective view of a recreational vehicle 30 and an awning assembly 32 of the present invention mounted thereon. The awning assembly 32 includes a awning 34 for providing shade to an area adjacent the recreational vehicle 30. A rug 36 is removably mounted to an outboard edge 66 of the awning 34 so as to hang downward from the outboard edge 66 of the awning 34 when the awning 34 is extended in the manner shown in FIG. 1. The rug 36 is preferably configured to be removed from the awning 34 and positioned on the ground below the awning 34. When not being used, the awning 34 and rug 36 are adapted to be conveniently stored within a common storage space, as described more fully below.

With reference to FIG. 1, the recreational vehicle 30 generally comprises a body 40 mounted on a wheel assembly 42 in a well-known manner. The body 40 generally comprises a front wall 44 and an opposed rear wall 46. A pair of side walls 50, 52 are mounted between the front wall 44 and the rear wall 46. A roof or top wall 54 of the recreational vehicle 30 is mounted on top of the front wall 44, the rear wall 46, and the side walls 50 and 52. A plurality of windows 56 can be located on the body 40. Additionally, a door 60 is pivotably mounted on the side wall 52 of the recreational vehicle 30 in a well-known manner. It will be appreciated that the awning assembly 32 may be used with recreational vehicles of various shapes and sizes and is not limited to use with the type of recreational vehicle shown in FIG. 1. For example, the awning assembly 32 may be used with a trailer-type recreational vehicles that is towed behind a powered vehicle.

With reference to FIG. 1, the awning assembly 32 includes the substantially flat awning 34 which extends outward from an awning roller or spool 120 which is mounted on the side wall 52 of the recreational vehicle 30, as described in more detail below. In the illustrated embodiment, the awning 34 is substantially rectangular-shaped and defines an inboard edge 64 located at the spool 120 and an opposed outboard edge 66. The awning 34 further defines a pair of opposed side edges 70 and 72 that each extend substantially normal to the inboard and outboard edges 64 and 66. The awning 34 preferably comprises a substantially flat or planar piece of material that may be stretched out as shown in FIG. 1. Desirably, the awning 34 is manufactured of material that is flexible and that may be easily rolled and unrolled without being plastically deformed. Additionally, the awning 34 is desirably manufactured of material that is resistant to damage from inclement weather, such as rain or wind. For example, the awning 34 may be made from a nylon mesh material of a type commonly used for awnings in the prior art.

As shown in FIGS. 1 and 2A–2C, a first and a second support member 76 and 80, respectively, are mounted to the side wall 52 of the recreational vehicle 30 in a cantilevered fashion. The first and second support members 76 and 80 are attached to the outer end 66 of the awning 34 so as to support the awning 34 in the extended fashion shown in FIG. 1. The first support member 76 comprises an elongated rod or bar having a first end 82 that is pivotably mounted to the side wall 52 of the recreational vehicle 30, as described more fully below. A second end 84 of the first support member 76 is removably mounted to the awning 34 to support the awning 34 in a stretched-out or suspended state. Preferably, the second end 84 of the first support member 76 is mounted to the comer of the awning 34 where the side edge 70 meets the outboard edge 66 of the awning 34.

Similarly, the second support member 80 comprises an elongated rod or bar having a first end 86 pivotably mounted to the side wall 52 of the recreational vehicle 30, as described more fully below. The second support member 80 also has a second end 90 that is removably attached to the awning 34 to further support the awning 34 in the stretched-out or suspended state. Preferably, the second support member 80 is mounted to the corner of the awning 34 where the side edge 72 meets the outboard edge 66 of the awning 34. It will be appreciated that other support structures could also be used to provide support to the awning 34. For example, a pair of rigid rods could be mounted along the side edges 70 and 72 of the awning 34.

As shown in FIG. 1, the awning assembly 32 further comprises a carpet or rug 36 that is removably mounted to the outboard edge 66 of the awning 34 so as to hang downward in the manner shown in FIG. 1 when the awning 34 is extended. For illustrative purposes, the rug 36 is shown using phantom lines. In the illustrated embodiment, the rug 36 is rectangular-shaped and defines a first edge 92 and an opposed second edge 94 that extends substantially parallel to the first edge 92. The rug 36 further defines a pair of opposed side edges 96, 100 that extend substantially normal to the first edge 92 and the second edge 94. In this embodiment, the distance between the side edges 96 and 100 of the rug is less than or equal to the distance between the side edges 70 and 72 of the awning. The rug 36 comprises a flat or planar piece of material of the type that is commonly used for rugs or floor coverings. Additionally, the rug 36 is preferably made of a flexible material that may be rolled and unrolled without being plastically deformed, and which is highly resistant to damage from water and dirt and from being stepped-on.

Figure 2A:
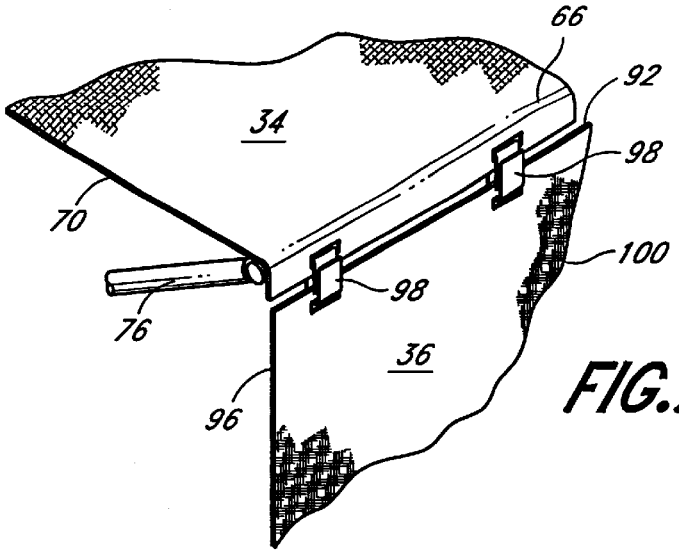
FIGS. 2A–2C are enlarged perspective view of a portion of an awning and rug of the awning assembly shown in FIG. 1.

As shown on FIG. 1, the rug 36 is adapted to be suspended from the outboard edge 66 of the awning 34. Specifically, the first edge 92 of the rug 36 is aligned parallel with and removably attached to the outboard edge 66 of the awning 34 using suitable attachment means. FIG. 2A is an enlarged perspective view of the interface between the awning 34 and the rug 36. A plurality of fasteners 98 extend across the awning 34 and the rug 36 where the outboard edge 66 of the awning 34 meets the first edge 92 of the rug 36.

The fasteners 98 removably fasten the outboard edge 66 of awning 34 to the first edge 92 of the rug 36. In the embodiment shown in FIG. 2A, the fasteners 98 comprise complementary strips of hook and loop fastening material, such as VELCRO™, which are removably coupled to one another.

Figure 2B:
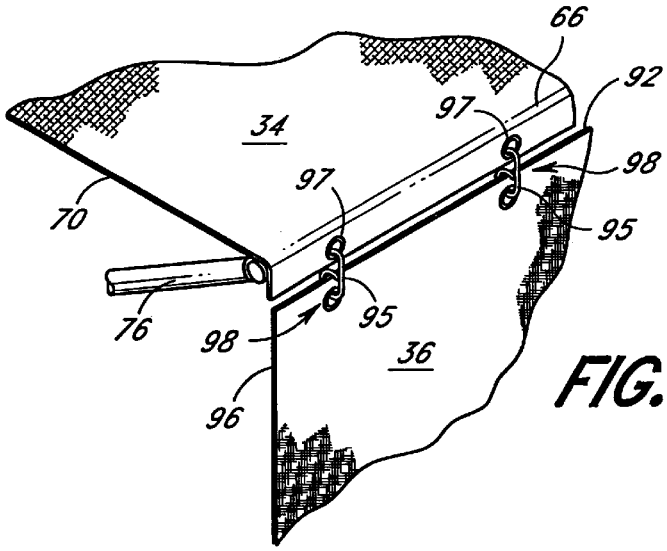
Figure 2C:
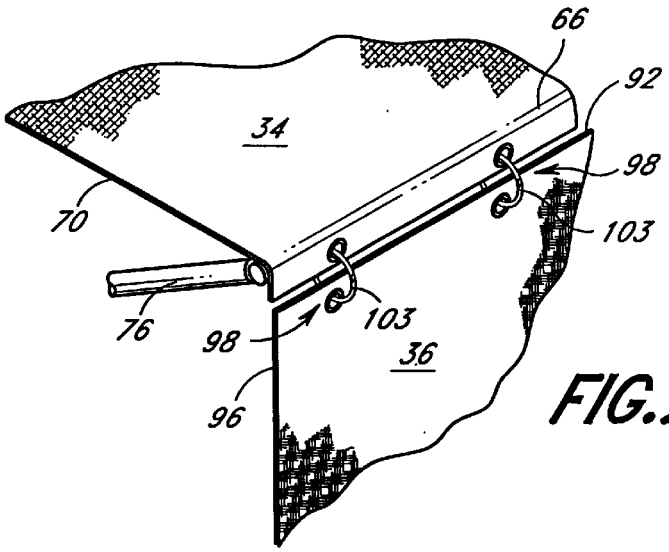

In another embodiment shown in FIG. 2B, the fasteners 98 comprise a plurality of hooks 95 that are attached to the first edge 92 of the rug 36. The hooks 95 are adapted to mate with a corresponding plurality of holes 97 that are positioned adjacent the outboard edge 66 of the awning 34. In yet another embodiment shown in FIG. 2C, the fasteners 98 comprise clamps 103 that are attached to the first edge 92 of the rug 36 and removably clamp onto holes 97 on the outboard edge 66 of the awning 34. It will be appreciated that any of a wide variety of other fastening devices could also be used to removably fasten the rug 36 to the awning 34 and that the fastening devices could be attached to either the rug 36 or the awning 34. As discussed more fully below, a user may easily remove the rug 36 from the awning 34 by removing the fasteners 98 from engagement with the awning 34 or the rug 36.

Figure 3:
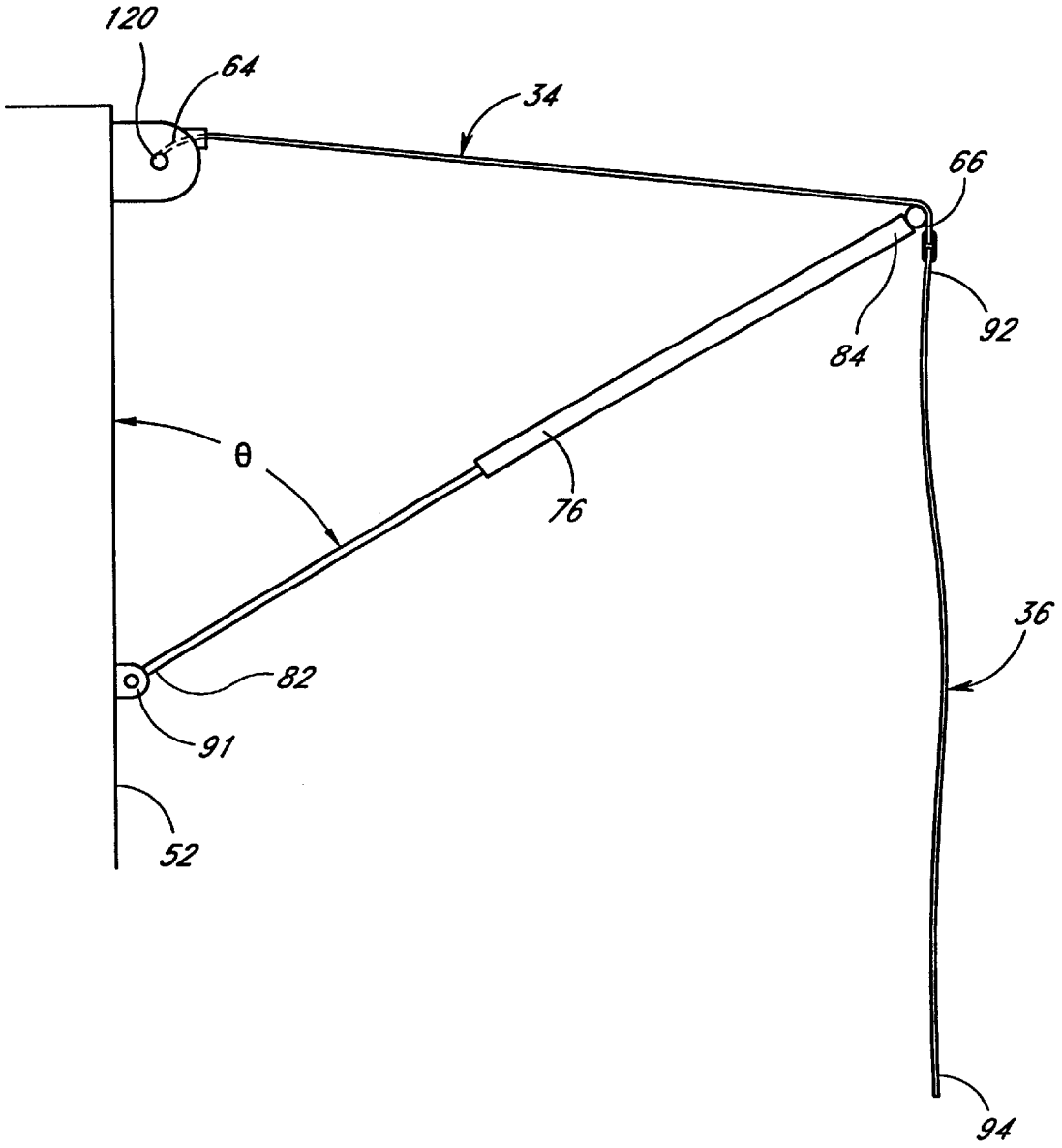
FIG. 3 is a side view of the awning assembly of a first embodiment of the present invention in an extended state.
Figure 4:
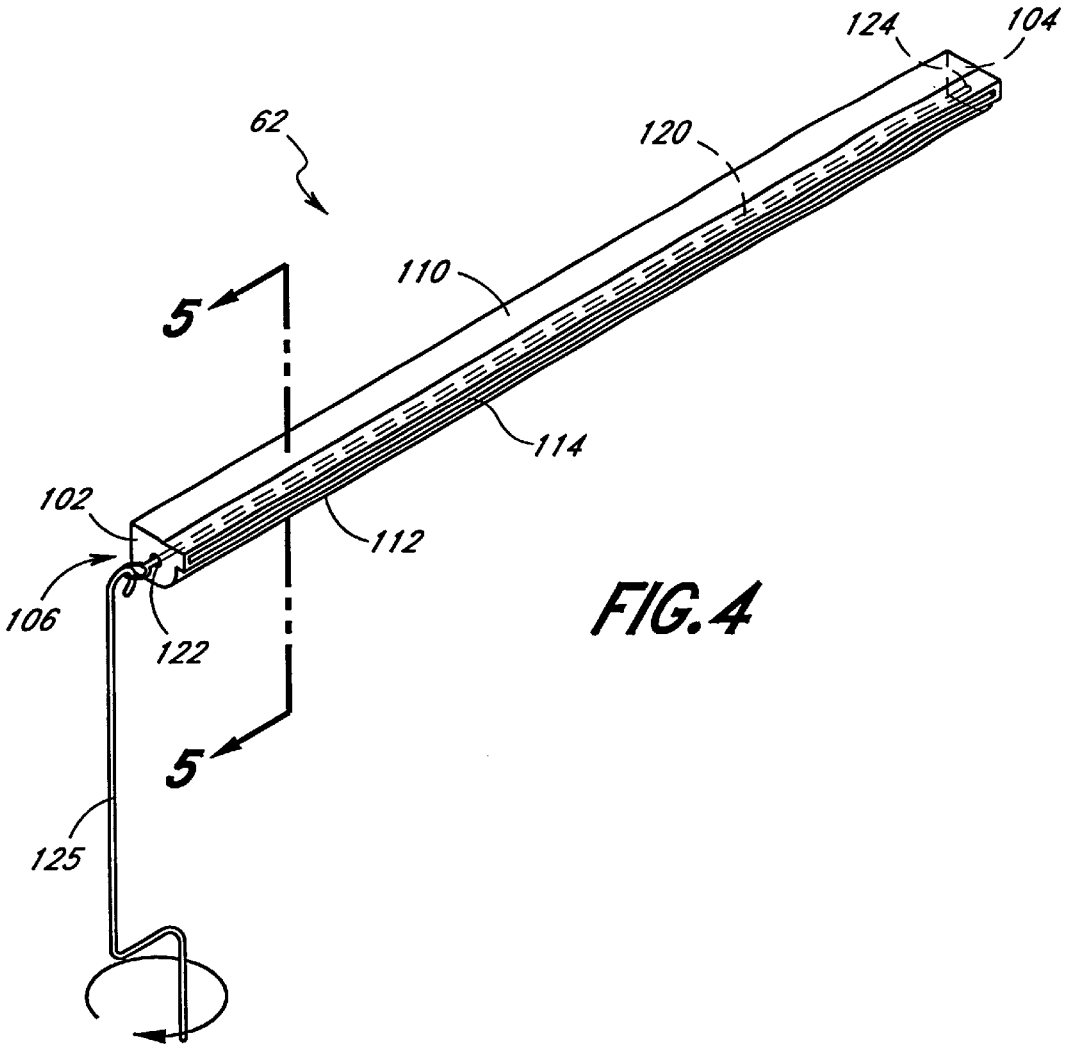
FIG. 4 is a perspective view of a storage housing of the awning assembly of a first embodiment of the present invention.

FIG. 3 is a side view of the awning assembly 32 shown in FIG. 1. In FIGS. 1 and 3, the awning assembly 32 is shown in an "extended" state in which the awning 34 is stretched outward and suspended from the side wall 52 of the recreational vehicle 30. That is, the inboard edge 64 of the awning 34 is positioned at the spool 120 and the outboard edge 66 is stretched outward from the side wall 52 of the recreational vehicle 30. Additionally, the spool 120 in the illustrated embodiment is positioned within an optional housing 62, as described in more detail below. When the awning assembly 32 is in the extended state, the first and second support members 76 and 80 extend at an angle $\theta$ relative to the side wall 52 of the recreational vehicle 30 to thereby support the awning 34 in the extended state. The first end 82 of the first support member 76 is preferably pivotably attached to a pivot mount 91 on the side wall 52 so that the first support member 76 may pivot around the first end 82 throughout the angle $\theta$. The second support member 80 is attached to the side wall 52 of the recreational vehicle 30 in an identical manner FIG. 4 is an enlarged view of the awning housing 62 in which the awning 34 and the rug 36 may be stored when not in use. The awning housing 62 is elongated and includes a pair of opposed side walls 102 and 104. The awning housing 62 also includes a rear wall 106 that is adapted to be mounted to the side wall 52 of the recreational vehicle 30. The awning housing 62 further includes an upper wall 110 and a lower wall 112 that are positioned between the side walls 102 and 104 of the awning housing 62. The upper wall 110 and the lower wall 112 of the awning housing 62 are spaced slightly apart so as to define an elongated opening 114 therebetween. The elongated opening 114 provides a passageway for the awning 34 and the rug 36 to be slid into or out of the awning housing 62, as described in more detail below.

With reference to FIG. 4, the spool 120 (shown in phantom) is journaled within the awning housing 62. The spool 120 has a first end 122 rotatably mounted to the side wall 102 of the awning housing 62 and a second end 124 rotatably mounted to the side wall 104 of the awning housing 62. A hook 123 extends outward from the first end 122 of the spool 120 so as to protrude through the side wall 102 of the housing 62. An arm 125 is sized to mate with the hook 123. The arm 125 may be attached to the hook 123 and be used to rotate the spool 120, as described more fully below. The spool 120 may also be spring mounted to the side walls 102 and 104 in a well known manner so that the spool 120 recoils in one rotational direction in response to being quickly rotated in the opposite direction.

Figure 5:
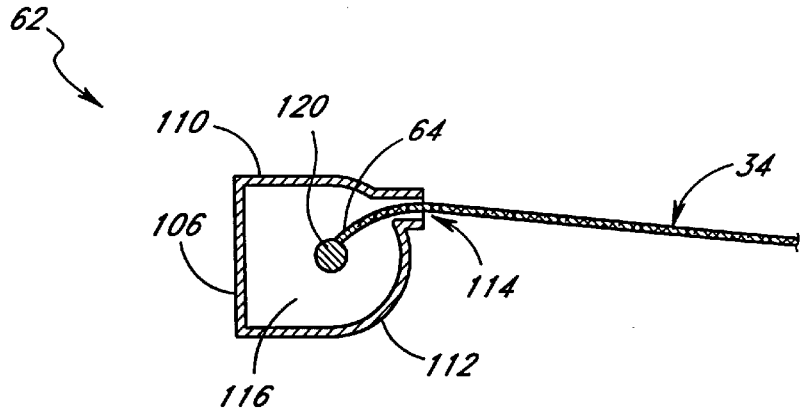
FIG. 5 is a cross-sectional view of the housing of FIG. 4 taken along line 5—5.

FIG. 5 is a cross-sectional view of the awning housing 62 along line 5—5 of FIG. 4. The cross-section of the awning housing 62 is rectangular or circular-shaped so that the awning housing 62 defines a storage space 116 therein. Desirably, the storage space 116 comprises a volume that is large enough to receive the awning 34 and the rug 36 in a non-extended state wherein the awning 34 and the rug 36 are coiled or wrapped around the spool 120, as described more fully below. The inboard end 64 of the awning 34 is attached to the spool 120 in a well-known manner.

The awning housing 62 may be attached to the side wall 52 of the recreational vehicle 30 using any suitable attachment means, such as, for example, screws, nuts and bolts, welding, etc. Alternatively, the awning housing may be integrally formed with the side wall 52 of the recreational vehicle 30. It is also contemplated that the awning housing 62 may be housed within the side wall 52. In such a case, an elongated opening preferably extends through the side wall 52 so as to communicate with the storage cavity 116 of the awning housing 62. It will be appreciated that the housing 62 is not required. That is, the spool 120 could be mounted on the recreational vehicle without the use of the housing 62. However, the housing 62 provides protection to the awning 34 and the rug 36 when they are being stored.

Figure 6:
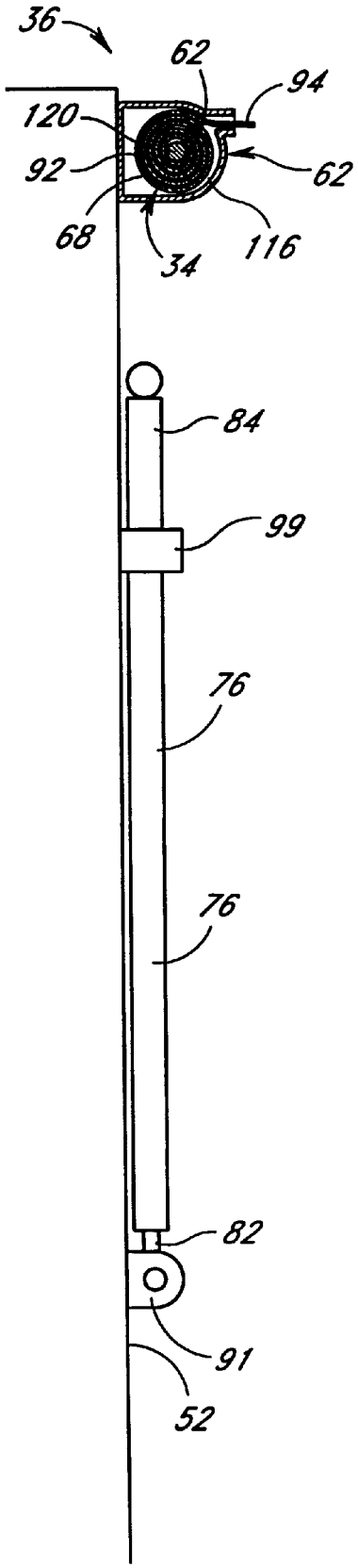
FIG. 6 is a side view of the awning assembly of a first embodiment of the present invention in a rolled state.

With reference to FIG. 6, the awning assembly 32 is configured to be moved to a non-extended or storage state wherein the awning 34 and rug 36 are both stored within the awning housing 62. In the non-extended state, both the awning 34 and the rug 36 are wound in series around the spool 120 with the outboard edge 66 of the awning 34 attached to the first edge 92 of the rug 36. Preferably, the second edge 94 of the rug 36 protrudes slightly from the elongated opening 114 of the awning housing 62 when the awning 34 and rug 36 are in the non-extended state. Additionally, the second edge 94 of the rug 36 preferably has a thickness that does not fit through the elongated opening 114 to inhibit the second edge 94 from sliding entirely into the awning housing 62.

The awning assembly 32 is preferably moved from the extended state (FIG. 3) to the non-extended state (FIG. 6) by rotating the spool 122 using the arm 125 (FIG. 4). Alternately, if the spool 122 is spring mounted, the awning assembly may be moved to the non-extended state by quickly tugging on the second edge 94 of the rug 36 so that the spool 120 quickly rotates in a first rotational direction. As mentioned, the spring mounting causes the spool to recoil in the opposite rotational direction in response to such action. The rotation of the spool 120, which is attached to the awning 34, pulls the awning 34 into the storage cavity 116 through the elongated opening 114 so that the awning 34 winds around the spool 120. The awning 34 in turn draws the attached rug 36 into the storage cavity 116 until the awning 34 and rug 36 are fully wound in series around the spool 120. A user may return the awning assembly 32 to the extended state by pulling on the protruding second edge 94 of the rug 36.

Preferably, the first and second support members 76 and 80 are disengaged from the awning 34 prior to winding the awning 34 and rug 36 into the awning housing 62. As mentioned, the first and second support members 76 and 80 are configured to pivot about their respective mounts 91 and to be positioned directly adjacent the side wall 52 of the recreational vehicle 30, as shown in FIG. 6. Preferably, at least one attachment member 99, such as a clamp, is located on the side wall 52 for fixing the position of the first and second support members 76 and 80 against the side wall 52 when not in use. The first and second support members 76 and 80 may be configured to telescope in size to reduce their sizes when not in use.

The awning assembly 32 is preferably used when the recreational vehicle 30 is at a stand-still, such as when the recreational vehicle 30 is parked in an RV park. Preferably, the awning assembly 32 is in the non-extended or rolled state when the recreational vehicle 30 is moving. Once the recreational vehicle 30 is parked in a suitable location, a user rotates the spool 122 using the arm 125 so that the awning 34 and rug 36 slide out of the awning housing 62 through the elongated opening 124. Alternately, a user may pull on the protruding second edge 94 of the rug 36 to thereby slide the rug 36 out of the awning housing 62 through the elongated opening 114. As the rug 36 slides out of the awning housing 62, the first edge 92 of the rug 36 draws the attached awning 34 out of the awning housing 62. Desirably, the rug 36 and awning 34 are fully slid out of the awning housing and the first and second support members 76 and 80 are then used to support the awning assembly 32 in the extended state, as shown in FIG. 1.

Figure 7:
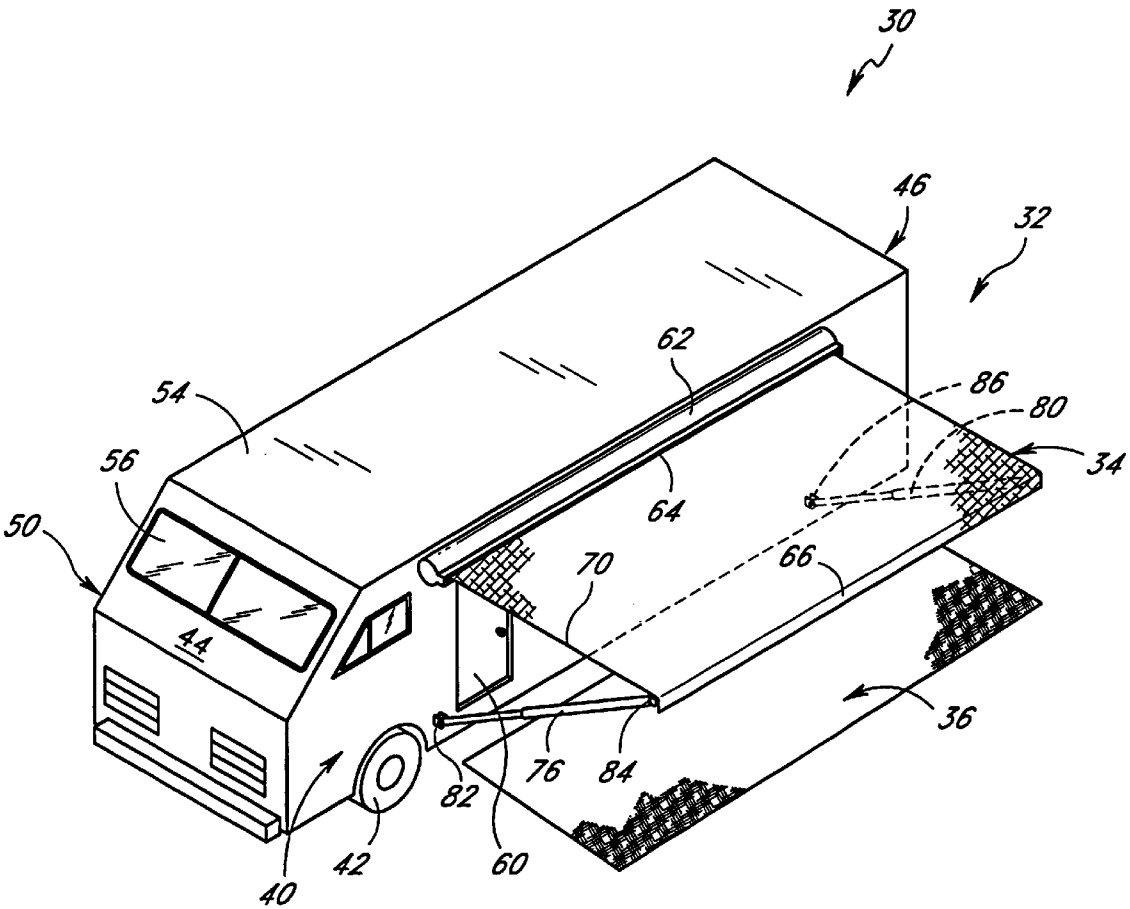
FIG. 7 is a perspective view of a recreational vehicle in which a rug is positioned on a ground surface below an extended awning.

The user then removes the rug 36 from the awning 34 by disengaging the fasteners 98. Preferably, the rug 36 is then placed on the ground below the awning, as shown in FIG. 7. The rug 36 functions as a ground cover for the area below the awning 34. When the user is ready to move the recreational vehicle, the rug 36 is again suspended from the outboard end 66 of the awning 34. The user may then remove any dirt or debris from the rug 36 while the rug 36 is hanging from the awning 34, such as by striking or wiping the rug 36. The hanging orientation of the rug 36 advantageously makes it easy for a user to clean the rug 36.

After the rug 36 has been attached to the awning 34, the user moves the awning assembly 32 to the rolled or non-extended state in which the awning 34 and rug 36 are stored within the awning housing 62. As mentioned, the user may use the arm 125 to rotate the spool 122 and pull the awning 34 and rug 36 into the awning housing 62. Alternately, if the spool 122 is spring mounted, the user may quickly tug the rug 36 or awning 34 slightly outward relative to the awning housing 62 to activate the spring-loaded spool 120 and cause the spool 120 to pull the awning 34 and the attached rug 36 into the awning housing 62. The rug 36 and awning 34 are conveniently both stored within the same awning housing 62 during non-use.

Figure 8A:
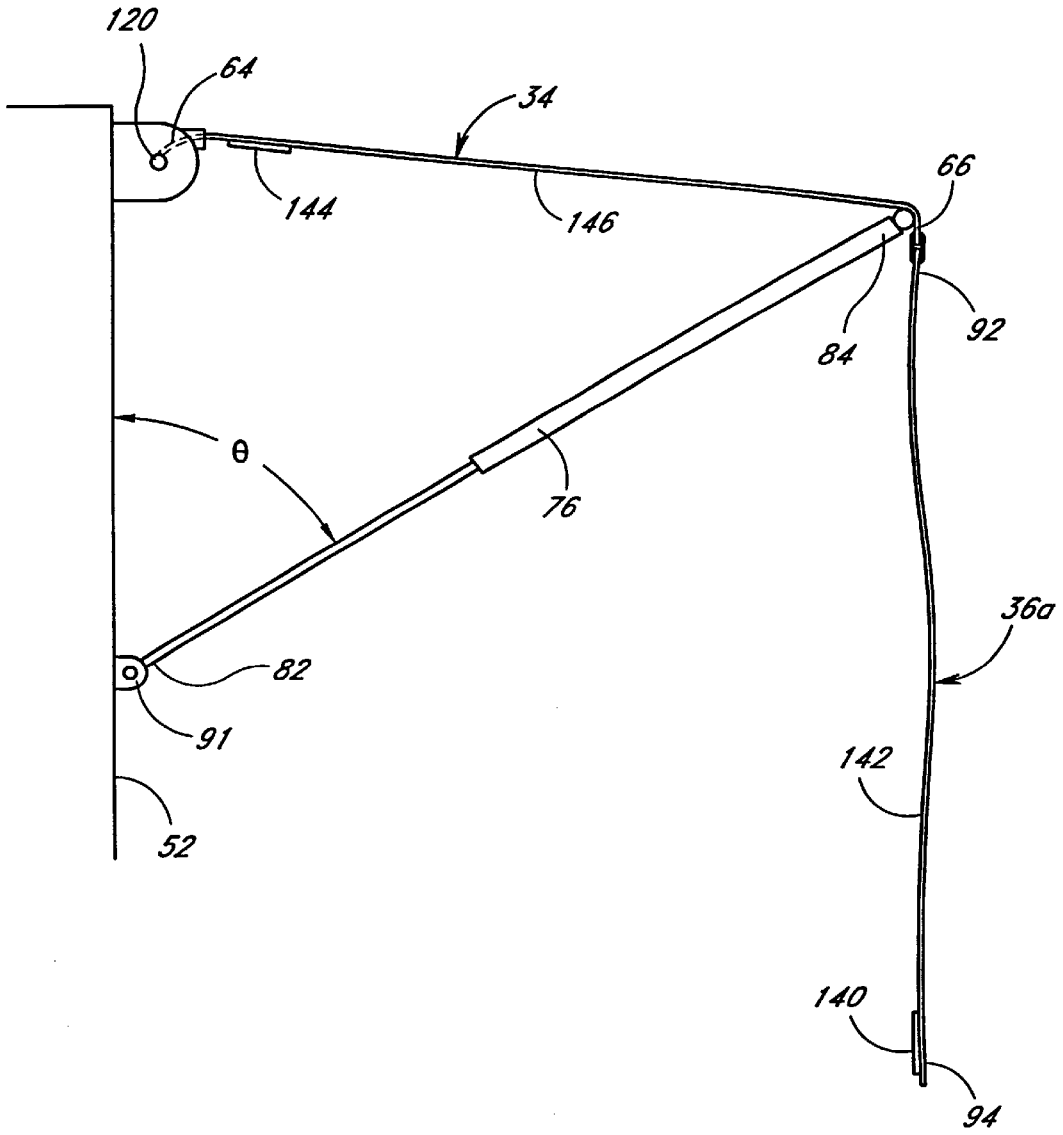
FIGS. 8A and 8B are side views of an alternative embodiment of the awning assembly of the present invention.
Figure 8B:
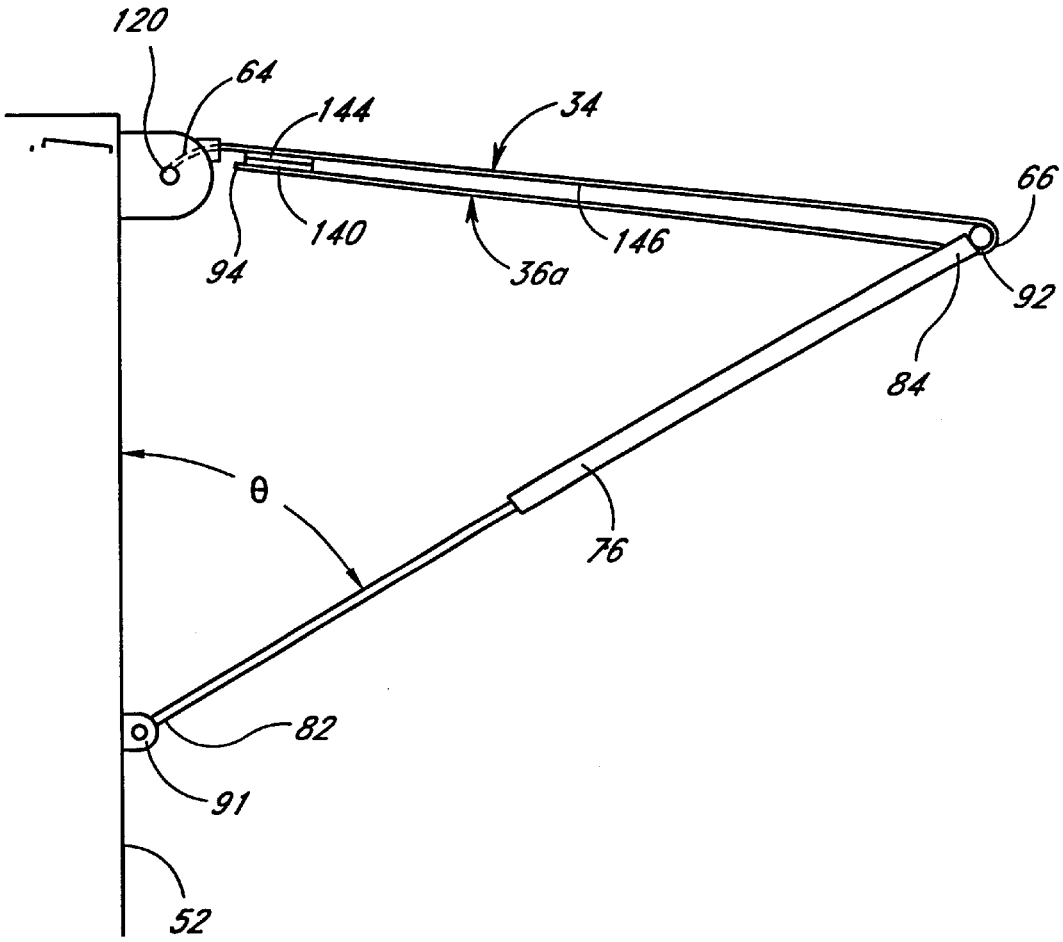

FIG. 8A shows an alternative embodiment of the awning assembly 32 which includes a rug 36*a*. An additional fastener 140 is positioned on an inner surface 142 of the rug 36*a*, preferably near the second edge 94. A corresponding fastener 144 is positioned on an inner surface 146 of the awning 34, preferably near the inboard edge 64 of the awning 34. In one embodiment, the fasteners 140 and 144 each comprise hook and loop material. With reference to FIG. 8B, the inner surface 142 of the rug 36 is positioned adjacent the inner surface 146 of the awning 34 so that the fastener 140 mates with the fastener 144 to thereby secure the rug 36 against the awning 34. The second end 94 of the rug 36 and inboard end 64 of the awning 34 may then be simultaneously rolled into the housing 62 until the outboard edge 66 of the awning 34 and the first edge 92 of the rug 36*a* protrude outward from the housing 62. In this manner, the rug 36*a* and awning 34 are rolled in "parallel" around the spool 120 and within the housing 62. When the awning 34 and rug 36 are stored in parallel, the likelihood of the awning 36 and rug 34 becoming pulled apart while unwinding the spool is greatly reduced.

The awning assembly 30 advantageously allows a traveler to bring the rug 36 on a trip and also conserve space within the recreational vehicle 30. Because the awning 34 and rug 36 are stored in a common awning housing 62, the rug 36 does not use any additional space than would otherwise be used for the awning 34. Advantageously, when the awning assembly 32 is moved to the extended state, the rug 36 is conveniently positioned near the area where it will likely be used. After use, the user simply hangs the rug 36 from the awning 34 where the rug may be easily cleaned. The user then simply winds the rug 36 and awning 34 into the awning housing 62 so that no additional dirt or debris is accumulated on the rug 36.

Figure 9:
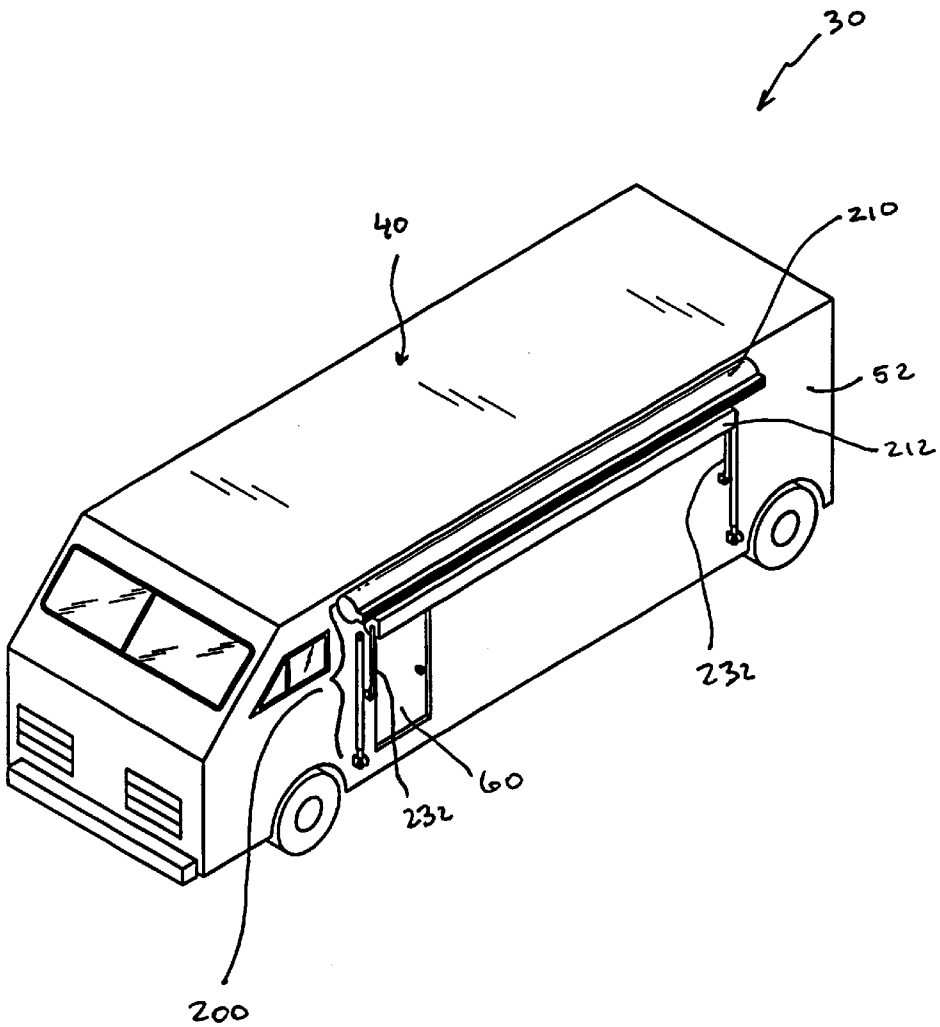
FIG. 9 is a perspective view of a second embodiment of the awning and rug assembly in a non-extended state.

FIGS. 9–13 show an alternate embodiment of the awning and rug assembly, which is referred to using the reference numeral 200. For ease of reference, like numerals will be used to refer to like parts between the embodiments. With reference to FIG. 9, the awning and rug assembly 200 comprises an awning housing 210 and a rug housing 212 that are each disposed on the side wall 52 of the recreational vehicle 30. The awning housing 210 and the rug housing 212 comprise elongated containers that are configured to store an awning 34 and a rug 36, respectively, in a rolled-up state, as described below. The housings 210 and 212 may have designs substantially similar to the housing described with respect to FIG. 4.

FIG. 9 shows the awning assembly 200 in a stowed or non-extended state in which the rug housing 212 is movably positioned above the door 60 and preferably immediately below the awning housing 210. In the stowed state, the awning 34 and rug 36 are rolled within the awning housing 210 and rug housing 212, respectively.

Figure 10:
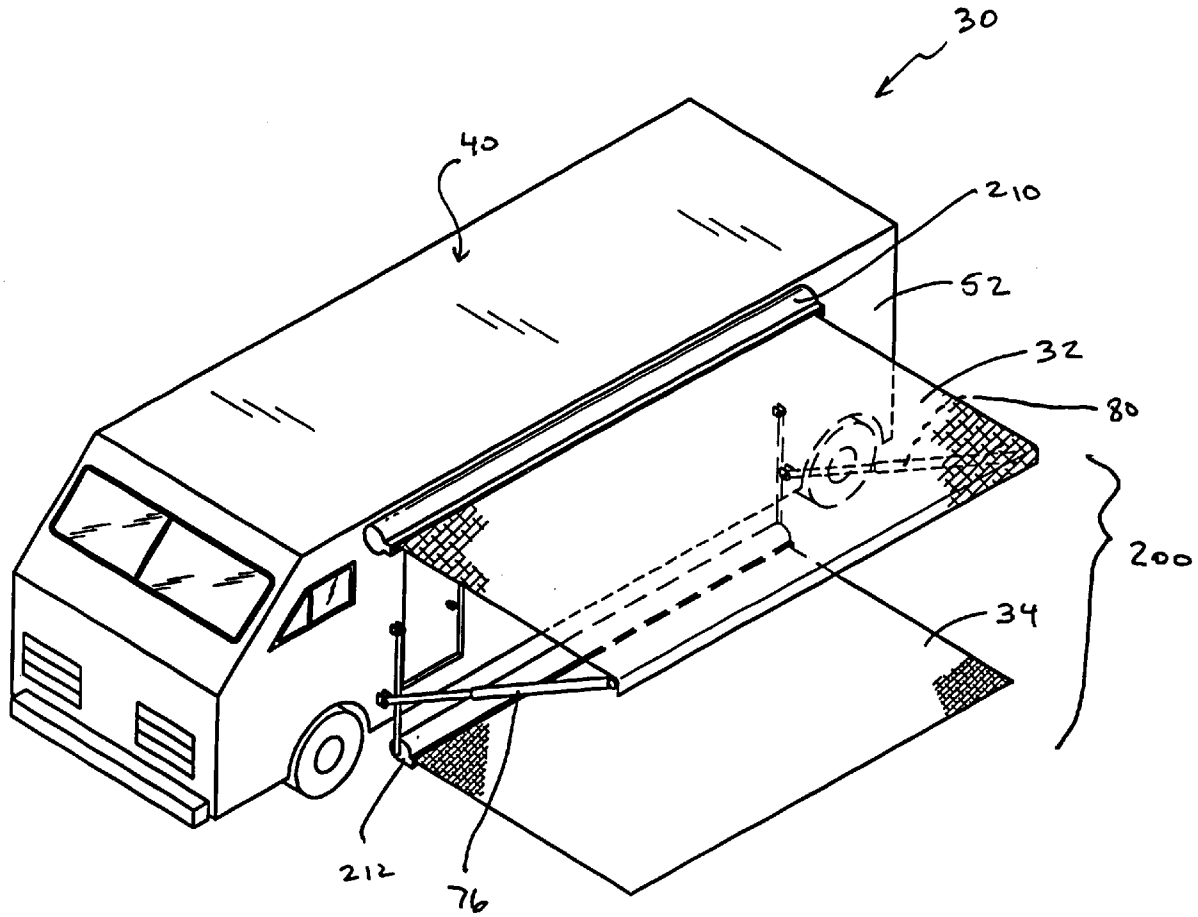
FIG. 10 is a perspective view of the awning and rug assembly of FIG. 9 in an extended state.

With reference to FIG. 10, the awning and rug assembly 200 may be transitioned to an extended state wherein the rug housing 212 is repositioned near a bottom edge of the side wall 52. When the awning and rug assembly 200 is in the extended state, the rug housing 212 is preferably located below a bottom edge of the door 60 and adjacent the ground surface upon which the recreational vehicle 32 is positioned. In the extended state, the awning 34 is extended from the awning housing 210 and suspended in a cantilevered orientation by a pair of support members 76, 80. The rug 36 is also extended from the rug housing 212 and positioned over a ground surface beneath the awning 34.

Figure 11:
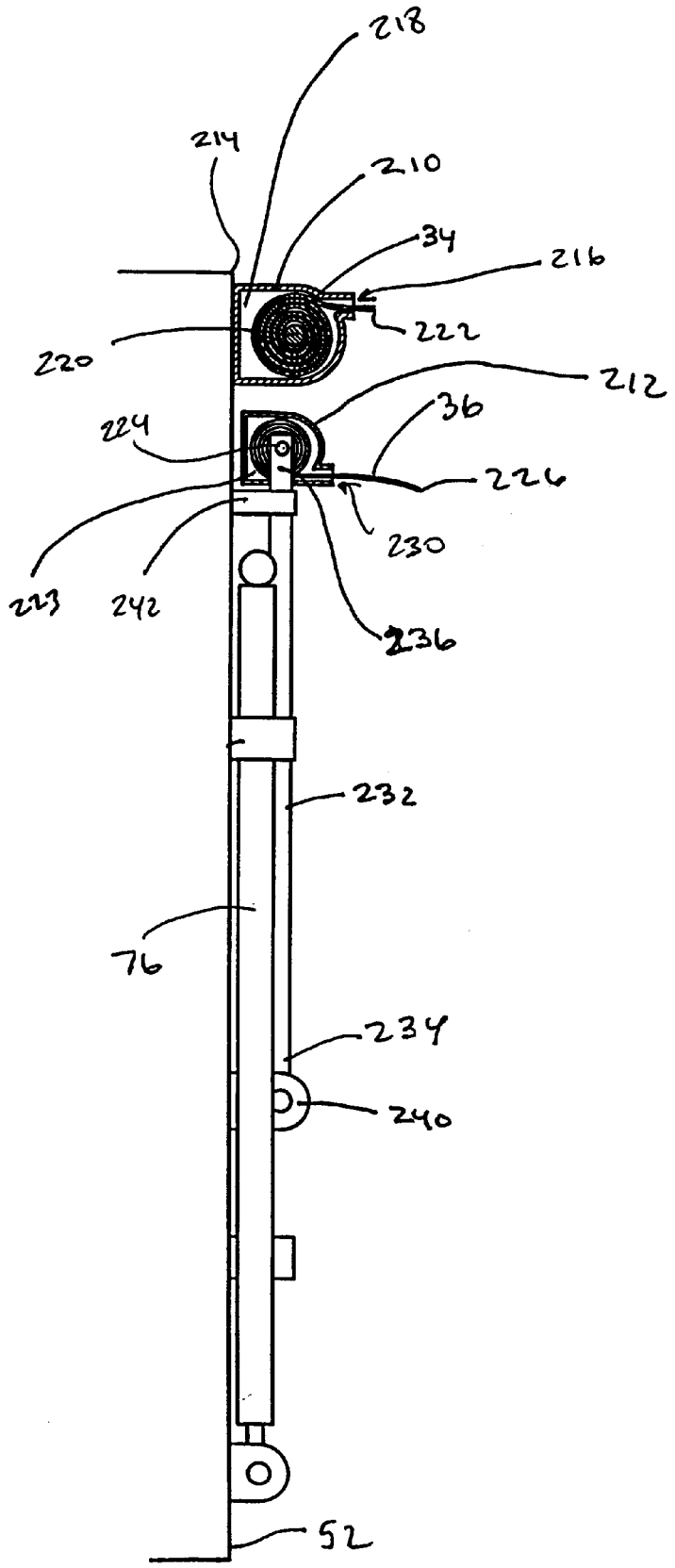
FIG. 11 is a side view of the awning and rug assembly of FIG. 9.

FIG. 11 is a side view of the awning assembly 200 in the stowed state. The awning housing 210 is preferably fixedly mounted near an upper edge 214 of the side wall 214. The awning housing 210 encloses an interior cavity 218 having a volume sufficient to receive the entire awning 34 when rolled. The awning housing 210 includes an elongated opening 216 having a size sufficient to receive the awning 34 therethrough. A storage structure, such as a rotatable spool 220, is coupled to the awning housing 210 so as to extend through the interior cavity 218, such as described above with respect to the housing of FIG. 4. Desirably, an inboard edge of the awning 34 is fixedly or removably attached to the spool 220. An outboard edge 222 of the awning desirably protrudes through the elongated opening 216 when the awning assembly 200 is in the stowed state.

At least one, and preferably two, support members 76 and 80 are mounted on the side wall 52. The support members 76, 80 are configured to support the awning in a suspended state, as described above with respect to the previous embodiment.

With reference to FIG. 11, the rug housing 212 encloses an interior cavity 223 that is sized to receive the rug 36 in a rolled-up state. A storage structure, such as a rotatable spool 224, is coupled to the rug housing and extends centrally through the interior cavity 223. The rug 36 is fixedly or removably attached to the spool 224 at an inboard edge of the rug 36. The spool 224 may be mounted in any of a wide variety of manners to the rug housing 212, such as through the use of a spring mount, a freely-rotating mount, etc. An outboard edge 226 of the rug 36 desirably protrudes through an elongated opening 230 in the rug housing 212 when the rug 36 is fully rolled within the rug housing 212.

Figure 12:
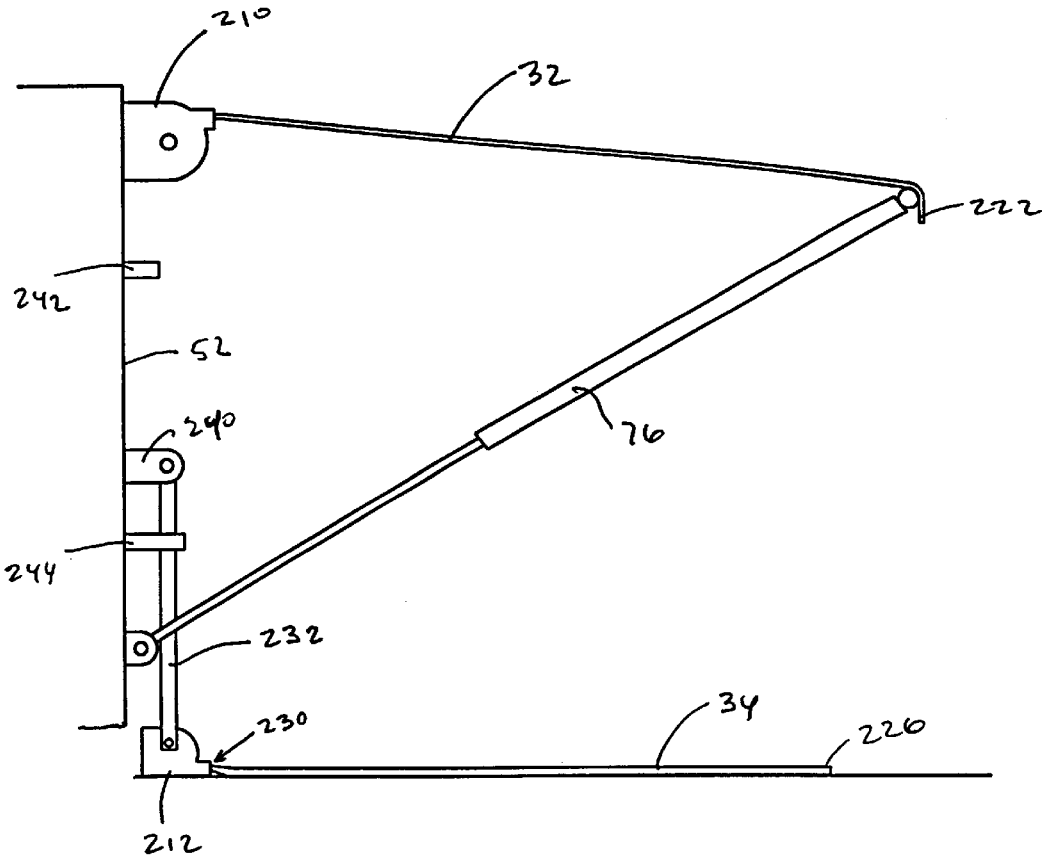
FIG. 12 is a side view of the awning and rug assembly in an extended state.

The rug housing 212 is supported by at least one support member, such as a support rod 232, so that the rug housing 212 is positioned adjacent the side wall 52, preferably immediately below the awning housing 210. The support rod 232 has a first end 234 that is rotatably attached to the side wall 52 using any well known rotatable attachment mechanism, such as a pin coupling 240. A second end 236 of the support rod is rotatably attached to the rug housing 212. The pin coupling 240 allows the support rod 232, and the attached rug housing 212, to be rotated between a first position in which the support rod 232 extends upwardly from the pin coupling 240 (FIG. 11) and a second position in which the support rod 232 extends downwardly from the pin coupling 240 (FIG. 12). Desirably, an attachment device, such as a clamp 242 is disposed on the side wall 52. The clamp 242 may be coupled to the support rod 232 to secure the support rod 232 in the first position.

The support rod 232 desirably has a length such that the rug housing 212 is positioned in an unobtrusive location when the support rod 232 is in the first position. That is, the rug housing 212 is desirably located away from areas where it may interfere with movement of the passengers/operators of the vehicle 232. For example, in the illustrated embodiment, the rug housing is located near the upper edge 214 of the side wall 52, preferably above the door 60 (FIG. 9) of the vehicle 32 and below the awning housing 210. In this location, the rug housing 212 does not interfere with movement of persons around the vehicle 32. However, the rug housing 212 is in a location that provides easy and ready access should the user have need of the rug 36. The support rod 232 may comprise a telescoping rod of variable length that allows the user to adjust the location of the rug housing 212 as desired.

FIG. 12 is a side view of the awning and rug assembly 200 in an extended state. When the awning and rug assembly 200 is in the extended state, the outboard edge 222 of the awning 32 is drawn out from the awning housing 210 so that the awning 32 is stretched over a desired amount of ground area. As described above with respect to the previous embodiment, the support members 76 and 80 are used to support the outboard edge 222 of the awning 34 in the extended state.

With reference to FIG. 12, the support rod 232 associated with the rug housing 212 is downwardly-extended when the awning and rug assembly 32 is in the extended state. The support rod 232 preferably has a length such that the rug housing 212 is located on or near the ground surface. As mentioned, the support rod 232 may also have an adjustable length for repositioning the rug housing 212 as desired. Preferably, the rug housing 212 is shaped such that the elongated opening 230 is located flush against the ground surface so as not to create any gaps between the rug 36 and the ground surface when the rug 36 is extended. A securing mechanism, such as a clamp 244, may be mounted on the side wall 52 for coupling to the support rod 232 and thereby securing the support rod 232 in the second position.

When the awning and rug assembly is in the extended state, the outboard edge 226 of the rug 36 is extended outward from the rug housing 212 so that the rug 36 is stretched over the ground surface. As mentioned, the rug 36 may be detachably mounted to the rug housing 212 so that a user may position the rug 36 in any of a wide variety of locations. Alternatively, the rug 36 may be fixedly mounted to the rug housing 212 for use only below the awning 34.

The awning and rug assembly 200 is desirably maintained in the stowed state during operational movement of the recreational vehicle 32. When the vehicle 32 is parked, a user may extend the awning 34 from the awning housing 210 by pulling on the outboard edge 222 of the awning 34. With the support members 76 being used to support the awning 34 in the extended state, the awning 34 provides shielding from the sun and the elements, as shown in FIGS. 10 and 12. With the awning 34 extended, the rug 36 may be maintained in either the extended state (for use of the rug 36) or in the stowed state (if use of the rug 36 is not required). Advantageously, as shown in FIGS. 9 and 11, the rug housing 212 is disposed in above the door 60 in a position where it will not interfere with movement of vehicle occupants during non-use.

Should the user desire to use the rug 36, the awning housing 212 is moved downward to the extended position by first unlatching the support rod 232 from the latch 242. The user then rotates the support rod 232 about the pin coupling 240 until the support member extends downwardly from the pin coupling 240, with the rug housing 212 located near the ground surface, as shown in FIGS. 10 and 12. The support rod 232 is then desirably secured in place using the latch 244. The user is then free to pull on the outboard edge 226 of the rug 36 to thereby stretch the rug over the ground surface. As mentioned, the rug 36 may be detachably mounted to the rug housing 212 if desired.

Figure 13:
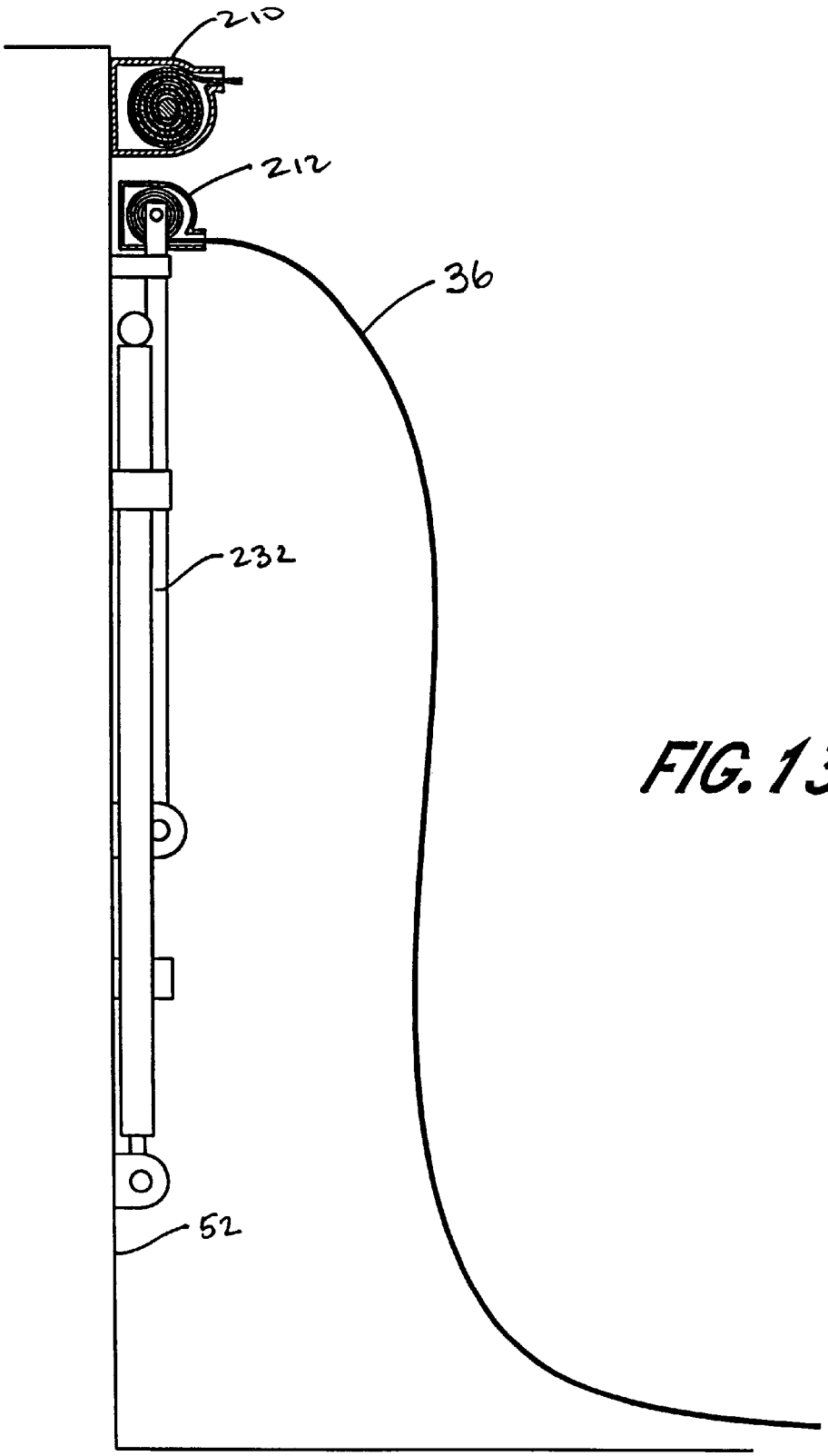
FIG. 13 is a side view of the awning and rug assembly in a non-extended state with the rug partially deployed for cleaning.

After use, the awning 34 may be rolled back into the awning housing 210, such as by quickly tugging on the awning 34 if it is spring mounted or by using any well known manual re-rolling mechanisms. The rug 36 is then also re-rolled into the rug housing 212 for storage. Alternately, the support members 232 of the rug housing 212 may be returned to the first position prior to re-rolling the rug 34 into the rug housing 212. The rug 36 is then advantageously suspended in a hanging position, as shown in FIG. 13, wherein the rug 36 extends downwardly from the elevated rug housing 212. The user may then strike the rug 36 with a club or other object to remove debris that may have accumulated on the rug during use. The clean rug 36 is then re-rolled into the rug housing 212.

The rug and housing assembly 200 is configured for efficient storage and operation of the awning 34 and rug 36. Advantageously, the rug housing 212 is maintained in an out-of-the-way location during non-use. The rug housing 212 is, however, maintained in a location that provides easy access to the rug 36 whenever the awning 34 is used. Advantageously, when the rug housing 212 is moved to the extended state, the rug 36 is conveniently positioned near the area where it will likely be used. After use, the user may easily elevate the housing 212 using the support rod 232 to thereby hang the rug 36 for easy and convenient cleaning. The user then simply winds the rug 36 into the rug housing 212 so that no additional dirt or debris is accumulated on the rug 36.

Although the foregoing description of the invention has shown, described and pointed out fundamental novel features of the invention, it will be understood that various omissions, substitutions, and changes in the form of the detail of the apparatus and method as illustrated and described, as well as the uses thereof, may be made by those skilled in the art without departing from the spirit of the present invention. Consequently, the scope of the invention should not be limited to the foregoing discussion, but should be defined by the appended claims.

What is claimed is:

1. An outdoor assembly for a recreational vehicle, comprising:

a rug;

a rug housing coupled to the rug and to a wall of the recreational vehicle, the rug housing defining an interior volume sized to store a rug in a rolled state, wherein the rug is configured to be extended from the rug housing through an opening that communicates with the interior volume;

at least one support member attached to the rug housing, the support member being movable between a first position wherein the rug housing is supported in a location adjacent an upper edge of the recreational vehicle, and a second position wherein the rug housing is supported in a location adjacent a ground surface upon which the recreational vehicle is located.

2. The assembly of claim 1, additionally comprising:

an awning;

an awning housing attached to the side wall of the recreational vehicle, the awning housing defining an interior volume sized to receive the awning in a rolled state, wherein the awning may be extended outward from the awning housing in a suspended state.

3. The assembly of claim 2, wherein the awning housing is located above the rug housing.

4. The assembly of claim 1, wherein the awning housing is disposed above a door of the recreational vehicle when the support member is in the first position.

5. The assembly of claim 1, wherein the support member comprises a rod.

6. The assembly of claim 5, wherein the rod has an adjustable length.

7. An outdoor assembly for a recreational vehicle, the assembly comprising:

an awning assembly having an awning that has a stored configuration and a deployed configuration, wherein the awning assembly includes a roller that is positioned adjacent the sidewall of the recreational vehicle about which the awning is rolled when the awning is in the stored configuration wherein the awning is deployed outward from the roller and the sidewall of the vehicle when the awning is in the deployed configuration;

a rug assembly having a rug adapted to be positioned on the ground adjacent the recreational vehicle that has a stored configuration and a deployed configuration, wherein the rug assembly includes a roller that is positioned adjacent the sidewall of the recreational vehicle about which the rug is rolled when the rug is in the stored configuration, wherein the rug is deployed outward from the roller and the sidewall of the vehicle when the rug is in the deployed configuration.

8. The assembly of claim 7, wherein the rug assembly includes at least one support member attached to the roller, the support member being movable between a first position wherein the roller is supported in a location adjacent an upper edge of the recreational vehicle, and a second positioned wherein the roller is supported in a location adjacent a ground surface upon which the recreational vehicle is located.

9. The assembly of claim 8, wherein the at least one support member comprises a first and a second support members that are positioned adjacent the ends of the roller.

10. The assembly of claim 8, wherein the first and second support members are mounted to the side of the recreational vehicle so as to be pivotally movable between the first position and the second position.

11. The assembly of claim 10, further comprising a housing that is mounted to the first and the second support members and wherein the roller is positioned within the housing and wherein the housing defines an aperture extending substantially the entire length of the housing so that the rug can be extracted from the interior of the housing through the opening.

12. The assembly of claim 11, wherein the rug is detachable from the roller.

13. A rug assembly adapted to be mounted to the sidewall of a recreational vehicle comprising a rug and a means for storing the rug wherein the rug is mounted on the means for storing the rug in a storage configuration such that the rug is maintained in a compact configuration adjacent the sidewall of the vehicle when not in use and wherein the means for storing the rug permits selective deployment of the rug outward from the sidewall of the recreational vehicle.

14. The rug assembly of claim 13, further comprising an awning and a means for storing the awning wherein the awning is mounted on the means for storing the awning in a storage configuration such that the awning is maintained in a compact configuration adjacent the sidewall when not in use and wherein the means for storing the awning permits selective deployment of the awning outward from the sidewall of the recreational vehicle.

15. The assembly of claim 13, wherein the means for storing the rug includes a roller and at least one support member attached to the roller, the support member being movable between a first position wherein the roller is supported in a location adjacent an upper edge of the recreational vehicle, and a second positioned wherein the roller is supported in a location adjacent a ground surface upon which the recreational vehicle is located.

16. The assembly of claim 15, wherein the at least one support member comprises a first and a second support members that are positioned adjacent the ends of the roller.

17. The assembly of claim 16, wherein the first and second support members are mounted to the side of the recreational vehicle so as to be pivotally movable between the first position and the second position.

18. The assembly of claim 17, further comprising a housing that is mounted to the first and the second support members and wherein the roller is positioned within the housing and wherein the housing defines an aperture extending substantially the entire length of the housing so that the rug can be extracted from the interior of the housing through the opening.

19. The assembly of claim 18, wherein the rug is detachable from the roller.

* * * * *